US010470251B2

(12) United States Patent
Kazemi et al.

(10) Patent No.: US 10,470,251 B2
(45) Date of Patent: Nov. 5, 2019

(54) VOLTAGE-LEVELING MONOLITHIC SELF-REGULATING HEATER CABLE

(71) Applicant: Pentair Thermal Management LLC, Redwood City, CA (US)

(72) Inventors: Mohammad Kazemi, San Jose, CA (US); Peter Martin, San Ramon, CA (US); Linda D. B. Kiss, San Mateo, CA (US); Edward H. Park, Santa Clara, CA (US); Jennifer Robison, Redwood City, CA (US)

(73) Assignee: nVent Services GmbH, Schaffhausen (CH)

( * ) Notice: Subject to any disclaimer, the term of this patent is extended or adjusted under 35 U.S.C. 154(b) by 190 days.

(21) Appl. No.: 15/583,848

(22) Filed: May 1, 2017

(65) Prior Publication Data

US 2017/0318626 A1 Nov. 2, 2017

Related U.S. Application Data

(60) Provisional application No. 62/329,367, filed on Apr. 29, 2016.

(51) Int. Cl.
*H05B 3/14* (2006.01)
*H05B 3/56* (2006.01)

(52) U.S. Cl.
CPC ..... *H05B 3/146* (2013.01); *H05B 3/56* (2013.01); *H05B 2203/02* (2013.01)

(58) Field of Classification Search
CPC ..... H05B 3/146; H05B 2203/02; H05B 3/56; H01C 7/02
See application file for complete search history.

(56) References Cited

U.S. PATENT DOCUMENTS

| | | | |
|---|---|---|---|
| 2,905,919 | A | 9/1959 | Hermann et al. |
| 3,793,716 | A | 2/1974 | Smith |
| 3,858,144 | A | 12/1974 | Bedard et al. |
| 4,177,376 | A | 12/1979 | Horsma et al. |
| 4,242,573 | A | 12/1980 | Batliwalla |
| 4,246,468 | A | 1/1981 | Horsma |

(Continued)

FOREIGN PATENT DOCUMENTS

| | | | |
|---|---|---|---|
| CA | 2592074 | A1 | 6/2006 |
| CN | 201750573 | U | 2/2011 |

(Continued)

*Primary Examiner* — Kevin L Lee
(74) *Attorney, Agent, or Firm* — Quarles & Brady LLP

(57) ABSTRACT

A self-regulating electric heater cable includes a monolithic heater core of PTC material encapsulating a pair of bus wires, and a conductive layer disposed on an outer surface of the heater core such that the conductive layer levels the voltage generated at the outer surface of the heater core when an electric current is passed through the bus wires. The conductive layer draws the current evenly through lobes of PTC material encapsulating the bus wires. The conductive layer may be a coating, such as a conductive ink or paint, or may be an extruded or wrapped material applied to the heater core. Standard heater cable layers are applied over the conductive layer, including an electrically insulating layer that contacts a portion of the conductive layer and also may be separated, at points, from the conductive layer by one or more air gaps.

20 Claims, 8 Drawing Sheets

(56) References Cited

U.S. PATENT DOCUMENTS

| | | | | |
|---|---|---|---|---|
| 4,307,290 | A | 12/1981 | Bloore et al. | |
| 4,309,596 | A | 1/1982 | Crowley | |
| 4,314,145 | A | 2/1982 | Horsma | |
| 4,330,703 | A | 5/1982 | Horsma et al. | |
| 4,334,351 | A * | 6/1982 | Sopory | B29C 47/027 219/528 |
| 4,348,584 | A | 9/1982 | Gale et al. | |
| 4,444,708 | A | 4/1984 | Gale et al. | |
| 4,453,159 | A * | 6/1984 | Huff et al. | G01K 3/005 200/61.08 |
| 4,459,473 | A | 7/1984 | Kamath | |
| 4,471,215 | A | 9/1984 | Blumer | |
| 4,543,474 | A | 9/1985 | Horsma et al. | |
| 4,560,524 | A | 12/1985 | Smuckler | |
| 4,591,700 | A | 5/1986 | Sopory | |
| 4,668,857 | A | 5/1987 | Smuckler | |
| 4,785,163 | A | 11/1988 | Sandberg | |
| 4,919,744 | A * | 4/1990 | Newman | H01C 7/027 156/292 |
| 4,954,695 | A | 9/1990 | Smith et al. | |
| 5,111,032 | A | 5/1992 | Batliwalla et al. | |
| 5,300,760 | A | 4/1994 | Batliwalla et al. | |
| 6,111,234 | A | 8/2000 | Batliwalla et al. | |
| 6,288,372 | B1 | 9/2001 | Sandberg et al. | |
| 6,303,866 | B1 | 10/2001 | Lagreve et al. | |
| 6,958,463 | B1 | 10/2005 | Kochman et al. | |
| 7,321,107 | B2 | 1/2008 | Yagnik et al. | |
| 8,525,074 | B2 | 9/2013 | Fukushima et al. | |
| 8,525,084 | B2 | 9/2013 | O'Connor | |
| 2010/0059502 | A1 | 3/2010 | O'Connor | |
| 2016/0105930 | A1 | 4/2016 | Kiss et al. | |
| 2017/0238370 | A1* | 8/2017 | Pretorius et al. | H05B 3/56 219/549 |

FOREIGN PATENT DOCUMENTS

| | | | |
|---|---|---|---|
| CN | 202551381 | U | 11/2012 |
| CN | 103068083 | A | 4/2013 |
| CN | 203289673 | U | 11/2013 |
| CN | 203523065 | U | 4/2014 |
| CN | 103796349 | A | 5/2014 |
| CN | 104582033 | A | 4/2015 |
| EP | 0880302 | A2 | 11/1998 |

* cited by examiner

VOLTAGE-LEVELING MONOLITHIC SELF-REGULATING HEATER CABLE

CROSS-REFERENCE TO RELATED APPLICATIONS

This application is a non-provisional and claims the benefit of U.S. Prov. Pat. App. Ser. No. 62/329,367, having the same title, filed Apr. 29, 2016, and incorporated fully herein by reference.

FIELD OF THE INVENTION

The present invention generally relates to heater cables, and more specifically to self-regulating heater cables.

BACKGROUND OF THE INVENTION

Heater cables, such as self-regulating heater cables, tracing tapes, and other types, are cables configured to provide heat in applications requiring such heat. Heater cables offer the benefit of being field-configurable. For example, heater cables may be applied or installed as needed without the requirement that application-specific heating assemblies be custom-designed and manufactured, though heater cables may be designed for application-specific uses in some instances.

In some approaches, a heater cable operates by use of two or more bus wires having a high conductance coefficient (i.e., low resistance). The bus wires are coupled to differing voltage supply levels to create a voltage potential between the bus wires. A positive temperature coefficient (PTC) material can be situated between the bus wires and current is allowed to flow through the PTC material, thereby generating heat by resistive conversion of electrical energy into thermal energy. As the temperature of the PTC material increases, so does its resistance, thereby reducing the current therethrough and, therefore, the heat generated via resistive heating. The heater cable is thus self-regulating in terms of the amount of thermal energy (i.e., heat) output by the cable.

Heater cables can exhibit high temperature variations throughout the cable, both lengthwise along the length of the cable and across a cross-section of the cable. These high temperature variations may be caused by small high-active heating volumes (e.g., PTC material) within the heater cable that can create localized heating, as opposed to heat spread over a larger surface area or volume. At the same time, other PTC material intended to be a heating volume may actually be thermally inactive, as no or limited current is dissipated therein. Additionally, in certain configurations, heater cables can be relatively inflexible, or substantially rigid, thus making installation of the heater cable difficult. Further, heater cables are typically not configured to provide varying selective heat output levels by a user.

Though suitable for some applications, such heater cables may not meet the needs of all applications and/or settings. For example, a heater cable that reduces temperature gradients may be desirable in some instances. Further, a heater cable that is capable of producing selectable but balanced heat output levels may be desirable in the same or other instances. Further still, for manufacturing efficiencies, a heater cable that achieves the above goal while utilizing structures and manufacturing methods of existing cables may be desirable.

SUMMARY OF THE INVENTION

The present devices and systems provide a heater cable for generating heat when a voltage potential is applied. In particular, the heater cable may be a "monolithic" self-regulating (SR) heater cable in which a pair of bus wires is embedded in a core of thermally-active positive temperature coefficient (PTC) material. The present designs for a monolithic SR heater cable enable activating a large portion of heating cable core, allowing for a thermally-balanced heat generation in the heating cable. The thermal balancing is achieved by leveling the voltage applied to the core material that encapsulates the conductors. The voltage is leveled by a conductive layer, such as a coating, a co-extruded layer, or a wrapped element, in surface contact with entire outer surface or a significant portion of the outer surface of the PTC core encapsulating the bus wires. Among other benefits, the present thermally-balanced designs limit the maximum temperature of the product to a known value and distribute the thermal energy uniformly at or about the maximum level over all or a substantial portion of the cable, improving the overall lifetime of the product and the unconditional sheath temperature, and allowing the volume of core material to be reduced.

DETAILED DESCRIPTION

The present invention overcomes the drawbacks, mentioned above, of previous designs for monolithic SR heater cables by providing in various embodiments a heater cable having a minimized operational temperature gradient. The minimized temperature gradient results in improved thermal equalization, thereby reducing maximum temperature generated at localized points of the heater cable and improving the lifespan of the heater cable. Further, in some embodiments, a heater cable is provided that provides the minimized temperature gradient across a smaller PTC core than in previous designs while outputting a similar or greater amount of heat at the same power levels. Additionally or alternatively, embodiments of the present heater cable may be manufactured from existing monolithic SR heater cable components with little modification to the production equipment. In still other embodiments, the heater cable may be capable of selectively outputting varying levels of heat.

Figure 1:
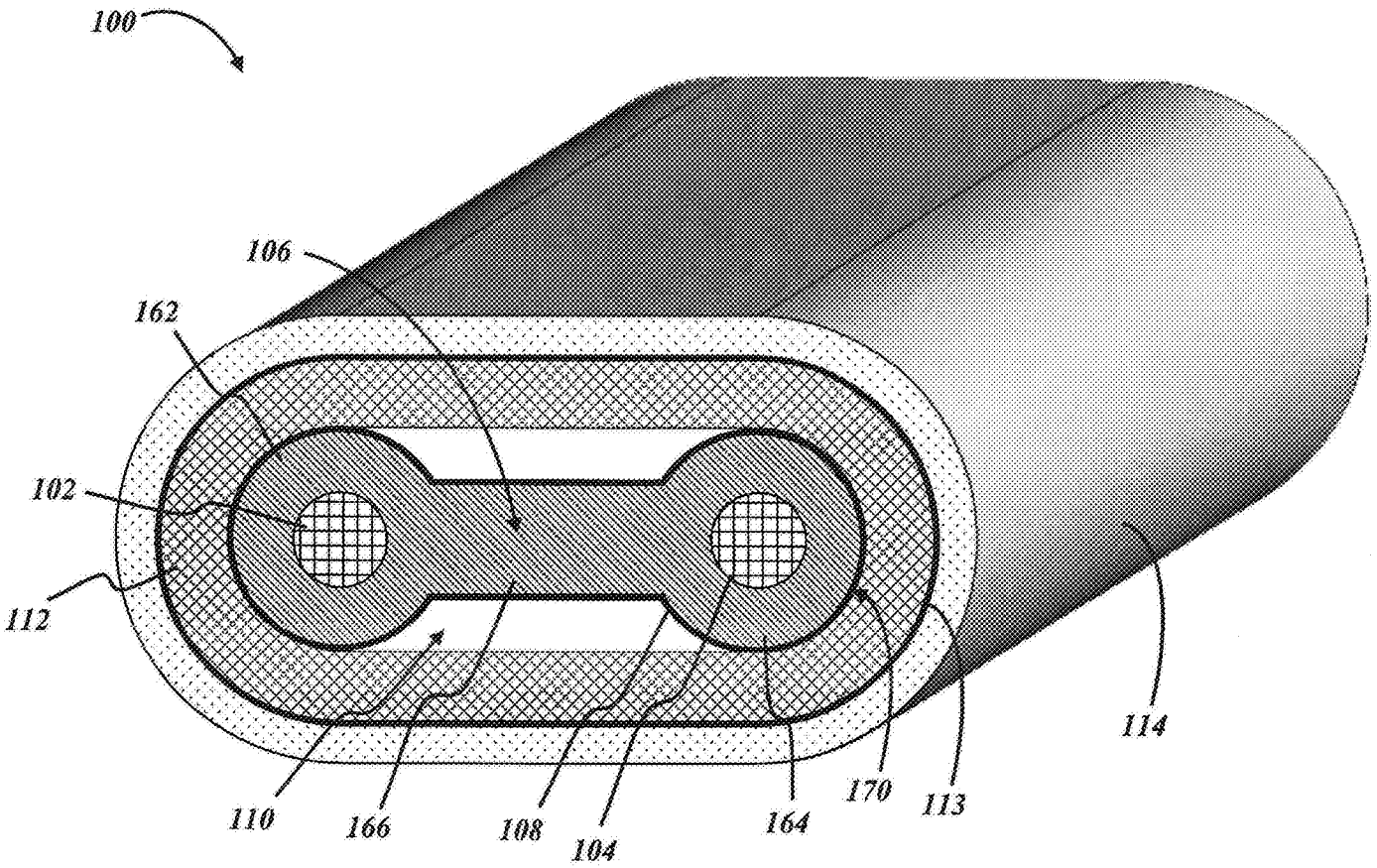
FIG. 1 is a cross-sectional diagram of a heater cable in accordance with various embodiments of the present disclosure.

Referring now to the figures, FIG. 1 illustrates a cross-sectional view of a heater cable 100 in accordance with various embodiments. The heater cable 100 includes cooperating bus wires 102, 104 that connect to opposite electrical terminals of a power supply and run parallel along the axial length of the heater cable 100. The bus wires 102, 104 may be embedded in a heater core 106, which is a semiconductive, positive temperature coefficient (PTC) polymer-based compound that surrounds the bus wires 102, 104 and spaces the bus wires 102, 104 apart from each other along the length of the cable 100. Any suitable PTC material, as is or becomes known in the art of self-regulating heater cables, may be used to form the heater core 106. Similarly, any suitable shape of the heater core 106 may be used in order to facilitate heat generation as is known in the art, though other components of the heater cable 100 may enable modifications 106 to known heater core 106 designs, such as a general reduction of volume, thickness, density, and other dimensions in order to reduce the weight, diameter, production time, cost, etc., of the heater cable 100 relatively to existing monolithic SR heater cable designs. Non-limiting exemplary designs of the heater core 106 are illustrated and described in detail herein.

In particular, FIG. 1 illustrates a "barbell" heater core 106 in which a first lobe 162 encircling the first bus wire 102 and a second lobe 164 encircling the second bus wire 104 are connected and spaced apart by a web 166 extending between them. In some embodiments, the lobes 162, 164 and web 166 may be integral with each other, such as by extruding or molding the heater core 106 over the bus wires 102, 104—thus, the heater cable 100 is monolithic in that the heater core 106 is a unitary piece of material encapsulating the bus wires 102, 104. In other embodiments, the lobes 162, 164 and web 166 may not be integral, instead being formed from different compositions of material that are joined at some point in the manufacturing process. In one example, the lobes 162, 164 and web 166 may each be separated extruded, and then joined together while in a semi-molten state, or joined by an adhesive after hardening. In another example, the different material compositions may be co-extruded to form the lobes 162, 164 and web 166. The barbell cross-sectional shape is caused by the web 166 having a thickness that is less than the diameter of the lobes 162, 164, though in other embodiments the web 166 may have a thickness equal to or greater than the lobes 162, 164.

While the heater core 106 may be modified from existing designs as described below, the heater cable 100 may include other components that are substantially similar to those of known SR heater cable designs. An electrically insulating layer 112, typically a fluoropolymer, polyolefin, or other thermoplastic, is disposed over the heater core 106 and provides dielectric separation of the heater core 106 from the outer layers and the surface of the heater cable 100. The insulating layer 112 may be a wrap or extruded jacket, which may create one or more air gaps 110 between the heater core 106 and the insulating layer 112, such as when the heater core 106 has a barbell shape. A ground layer 113, such as a metallic foil wrap, wire spiral wrap or a braid or other assembly of drain wires, is disposed over the insulating layer 112 and provides an earth ground for the heater cable 100 while also transferring heat around the circumference of the heater 100. A thin polymer outer jacket 114 is disposed over the ground layer 113 and provides environmental protection; the outer jacket 114 may include reinforcing fibers to provide additional protection.

In a typical monolithic SR heater cable, current flows directly from one bus wire 102 to the other bus wire 104 through the PTC material therebetween, the PTC material being the only conductive material inside the insulation layer 112 (besides the bus wires 102, 104 themselves). Thus, in the depicted heater core 106 absent the present design improvements, the current would travel through the web 166 and through the portions of the lobes 162, 164 between the bus wires 102, 104. The portions of the lobes 162, 164 that form the "curve" 170 around the bus wires 102, 104 would not receive any current. As a result, only the middle part of the typical cable, above and below the web 166, delivers thermal energy as heat; the sides of the typical cable are relatively "cold." Thermal output as well as thermal aging within the components are non-uniform, and a large web 166 is needed to dissipate the heat.

To balance heating of the heater core 106, the present cable 100 includes a conductive layer 108 disposed in surface contact with the outer surface of the heater core 106. In some embodiments, the conductive layer 108 may coat the entirety of the outer surface of the heater core 106, completely around the heater core 106 perimeter and along the length of the cable 100 (e.g., such that the air gaps 110 are between the conductive layer 108 and the insulating, layer 112). In other embodiments, the conductive layer 108 may be wrapped or otherwise disposed like a jacket around the heater core 106, which may allow the air gaps 110 to remain between the conductive layer 108 and the heater core 106. In still other embodiments, the conductive layer 108 may be in contact with only a portion or a plurality of discrete, spaced-apart portions of the outer surface, such that one or more portions of the heater core 106 are not covered by the conductive layer 108. For example, the conductive layer 108 may coat or be wrapped around the heater core 106 along a first length of the cable 100, then may be absent from a second length of the cable 100 adjacent to the first length, then may coat or be wrapped around a third length of the cable 100 adjacent to the second length; such a pattern may be extended along a certain length or the entire length of the cable 100, creating a composite or "hybrid" cable 100 having alternating voltage-leveled and non-voltage-leveled portions of the cable 100. The different portions of covered and uncovered (e.g., coated and uncoated) heater core 106 may have the same or varying lengths.

The conductive layer 108 may have a uniform or non-uniform thickness, the uniformity affecting the conductivity of the conductive layer 108. In various embodiments, the conductive layer 108 may have a thickness of between 0.01% and 100%, inclusive and preferably greater than 0.1%, of the largest thickness of the PTC material in the heater core 106. In other embodiments, the conductive layer 108 may be thicker than the PTC material, such as up to about 1000% of the PTC material thickness. The conductive layer 108 is disposed with respect to the bus wires 102, 104 to draw the current on the first bus wire 102 evenly through the first lobe 162, conduct the current within the conductive layer 108 toward the second bus wire 104, and dissipate the current evenly through the second lobe 164 into the second bus wire 104. This conductivity through the lobes 162, 164 may not completely dissipate the current, and some current may still travel through the web 166, also being drawn out to the outer surface and then back into the web 166 as the current approaches the second bus wire 104. Thus, with appropriately selected dimensions of the heater core 106, the conductive layer 108 serves to level the electric potential, and thus the voltage distribution, across the outer surface of the heater core 106 along the length of the cable 100.

Figure 2A:
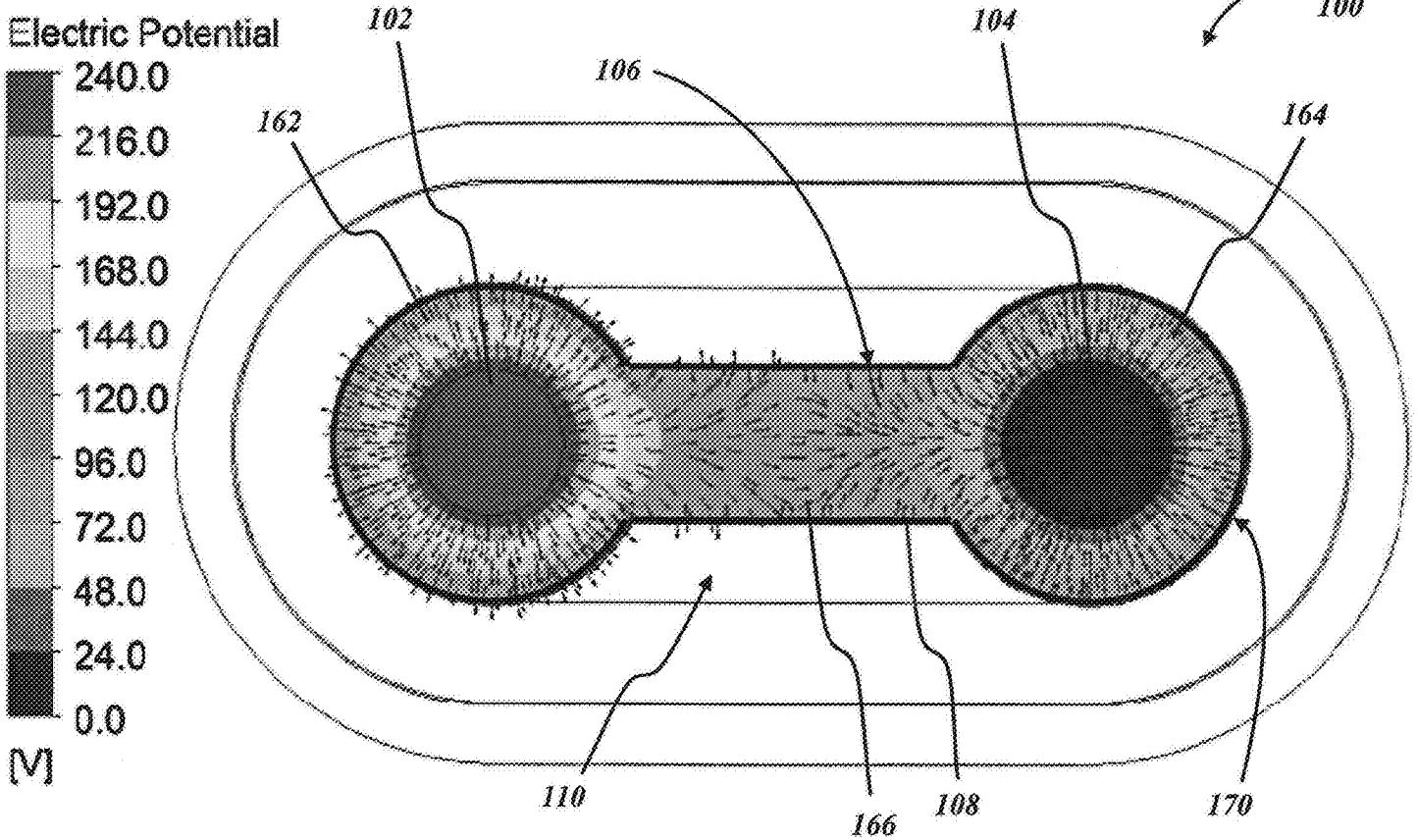
FIGS. 2A and 2B are cross-sectional diagrams illustrating electrical characteristics of the heater cable of FIG. 1 in accordance with various embodiments of the present disclosure.

Notably, in existing monolithic SR cable designs, the thickness of the lobes 162, 164 at the curve 170 is largely irrelevant to the electrical transmission and heat generation because the corresponding portions of the lobes 162, 164 do not dissipate any current. In the present designs of the heater cable 100, the curves 170 of the lobes 162, 164 are part of the conductive path—in fact, the lobes 162, 164 create a critical conductive path length of twice the thickness of an individual lobe 162, 164. Correspondingly, in some embodiments the thickness of the lobes 162, 164 may be selected so that the PTC material of the lobes 162, 164 does not suffer electrical breakdown or other damage under the voltage of the system. More specifically, the thickness of the lobes 162, 164 may be between 0.010 and 0.100 inches, inclusive, and particularly between 0.020 and 0.040 inches, inclusive, in a 240V system. Voltage leveling is achieved at the outer surface of the heater core 106, as shown in FIG. 2A, by the current entering or exiting the conductive layer 108 at or about the same potential difference (approx. 120V in a 240V system) at every point of contact between the conductive layer 108 and the heater core 106. In some described embodiments, the web 166 is effectively inactivated from a resistive heating standpoint, as shown by the ohmic loss plot of FIG. 2B. Nevertheless, heat is transferred from the middle of the heater cable 100 due to the distribution of heat by the conductive layer 108 substantially evenly across the surface area of the heater core 106. Additionally or alternatively, the PTC material of the web 166 may be heated by the lobes 162, 164 and may in turn transfer heat. Advantageously, the web 166 can be made as wide or as narrow as desired without affecting the thermal aging of the cable 100, allowing for customization of the cable width for different applications. See FIG. 3 and the description below of a cable with a minimal web. As the width of the web 166 does affect the surface area of the heat transfer surface of the heater core 106, the heater cable 100 must generate more power as the width increases in order to produce the same temperature.

Referring again to FIG. 1, the conductive layer 108 may be any suitable conductive material with a sufficiently high electrical conductivity to draw the current to the outer surface of the heater core 106 as described. In some embodiments, the conductive layer 108 may be a conductive ink or paint that is painted, sprayed, or otherwise deposited with the desired thickness on the surface of the heater core 106. In other embodiments, the conductive layer 108 may be a flowable metal, a conductive or semiconductive polymer, a polymer compound (e.g., doped with high levels of carbon nanotubes or carbon black), or another highly conductive material that can be extruded onto the heater core 106, co-extruded with the heater core 106, deposited via dipping the heater core 106, or otherwise deposited as a coating or disposed with an intimate surface contact (i.e., conformal cross-sectional profiles) with the heater core 106. Additionally or alternatively, an inner surface of the insulating layer 112 may be coated with the conductive layer 108.

In some embodiments, the conductive layer 108 can be initially made up of a slurry loaded with conductive particles (e.g., carbon black particles). The slurry may be applied to the heater core 106 and/or the insulating layer 112, and subsequently dried to remove the diluents post-application in order to form a flexible, solid material. In other embodiments, the conductive layer 108 may include carbon or graphite bound within a matrix to be a flowable and curable polymer. Other examples of possible conductive layer 108 materials include fluoropolymers, primary secondary amine (PSA) carbon black or other carbon blacks (including but not limited to conventional spherical shaped carbon black, acetylene black, amorphous black, channel black, furnace black, lamp black, thermal black, and single-wall or multi-wall carbon nanotubes), graphite (including but not limited to natural, synthetic, or nano), graphene, additives (for example, that may serve to enhance a particular property such as conductivity, dispersion, processability, flammability, environmental stability, cure enhancement, etc. and may include particulate additives such as zinc oxide (ZnO) or boron nitride (BN), organic additives, etc.), non-carbon-based (e.g., silver-based or polymer-based) conductive inks, and/or mixtures of any of the above.

In particular embodiments, the conductive layer 108 may be an electrically and thermally conductive carbon-based material, such as a carbon-based conductive ink, as described above. In some embodiments, this electrically and thermally conductive carbon based material can be a paracrystalline carbon coating, such as highly conductive specialty carbon black. Other suitable materials for the conductive layer 108 include conductive tape, foil, wire, or other flexible material that can be wrapped over the heater core 106. Such conductive articles may be made from a metal or metal laminate, conductive or semiconductive polymer or laminate, etc. In various embodiments, the conductive layer 108 may include coated and/or co-extruded highly conductive PTC materials containing metal powder/flakes. In various embodiments, the electrical conductivity of the conductive layer 108 may be at least 100 times higher than the electrical conductivity of the PTC material in the heater core 106, in order to achieve the described voltage leveling. In an exemplary embodiment, the conductive layer 108 material can have electrical conductivity between 1,000 to 10,000 higher than that in the heater core 106.

In some embodiments of manufacturing the cable 100, the conductive layer 108 may be dried or cured for a suitable period of time. When the conductive layer 108 has set, the insulating layer 112 and subsequent layers may be disposed over the heater core 106 as described above. Once assembled, the heater cable 100 may have an oval or stadium-shaped cross-section, as is shown in FIG. 1, with any desired width as described above. In other embodiments and in other application settings, the heater cable 100 may have a circular, triangular, or other cross-sectional shape if desired.

The heater core 106 can be feinted of various materials, including polymer compounds with conductive fillers and additives. These compounds can be made with polymers including, but not limited to, polyolefins (including, but not limited to polyethylene (PE), polyethylene blends and copolymers with acrylates and acetates such as ethyl vinyl acetate, ethyl ethacrylate, etc., polypropylene (PP), polymethylpentene (PMP), polybutene (PB), polyolefin elastomers (POE), etc.), fluoropolymers (ECA from DuPont™, Teflon® from DuPont™, perfluoroalkoxy polymers such as PFA or MFA homo and copolymer variations), polyethylenetetrafluoroethylene (ETFE), polyethylenechlorotrifluoroethylene (ECTFE), fluorinated ethylene-propylene (FEP), polyvinylidene fluoride (PVDF, homo and copolymer variations), Hyflon® from Solvay™ (e.g., P120X, 130X and 140X), polyvinylfluoride (PVF), polytetrafluoroethylene (PTFE), fluorocarbon or chlorotrifluoroethylenevinylidene fluoride (FKM), perfluorinated elastomer (FFKM)), and their mixtures. Various applications of the PTC material encapsulations are disclosed and/or contemplated herein. Conductive fillers for these compounds can include, but are not limited to, carbon black or other faults of carbon (including but not limited to conventional spherical shaped carbon black, acetylene black, amorphous black, channel black, furnace black, lamp black, thermal black, and single-wall or multi-wall carbon nanotubes, graphite, graphene), silver or other metal based fillers, electrically conductive inorganic fillers (including, but not limited to WC or TiC), and additives (for example, that may serve to enhance a particular property such as conductivity, dispersion, processability, flammability, environmental stability, cure enhancement, etc.

The PTC material of the heater core 106 operates as a heating element within the heater cable 100. The PTC material can generate heat, as the PTC material can have a substantially higher resistance than the bus wires 102, 104 (which have negligible resistances) and the conductive layer 108 (which can have a negligible to extremely low resistance). Resistive heating is generated by power dissipation. Power (P) is generally defined as P=I^2×R, where "I" represents current and "R" represents resistance. The heat generated by the PTC material is then transferred toward the outer jacket 114 of the heater cable 100, and subsequently to the exterior of the heater cable 100. The heat generated by the heater core 106 may then be transferred to materials or structures which are in close proximity or in contact with the heater cable 100, such as a pipe to which the heater cable 100 is attached to prevent freezing of the process fluid in the pipe (see FIG. 2C, temperature difference at bottom of the cable 100 plot indicates attachment of the cable 100 to a pipe (not shown)). Heat transfer from the heater core 106 can be affected, in some instances, by the highly thermally conductive characteristic of the conductive layer 108. For example, the conductive layer 108 can affect the temperature rating and/or power output of the heater cable 100 by providing even, leveled, or balanced current or voltage distribution throughout the heater cable 100. Further, the conductive layer 108 can increase the temperature rating of the heater cable 100 by allowing for even heat distribution, thereby reducing the possibility of hot spots within the heater cable 100.

The PTC material of the heater core 106 can limit the current passed through the PTC material based on the temperature of the PTC material. In particular, the PTC material will increase its electrical resistance as its temperature increases. The current correspondingly decreases, and the heat locally generated by the flow of current thereby decreases as well. Thus, the heater cable 100 can be self-regulating in that its resistance varies with temperature. In this manner, heat is regulated by the PTC material of the heater core 106 along the length of the heater cable 100 and across the cross-section of the heater cable 100. Further, the voltage leveling provided by the conductive layer 108 of the above implementation allows for the heater cable 100 to achieve the desired temperature set points along the entire length and cross-section. The increase in electrical paths provided by the conductive layer 108 can increase the active volume of the heater core 106 (i.e. increase the surface area of current flow through the PTC material), thereby lowering the overall temperature of the heater core 106 and reducing localized heating. These effects together serve to maximize thermal equalization within the heater cable 100, resulting in more consistent heating along the entire length of the heating cable 100. This may improve the lifespan of the heater cable 100 and reduce the potential for premature failure due to degradation. Further, these effects may improve the unconditional sheath temperature classification of the heater cable 100 as specified by European norm EN60079-30-1.

Figure 2B:
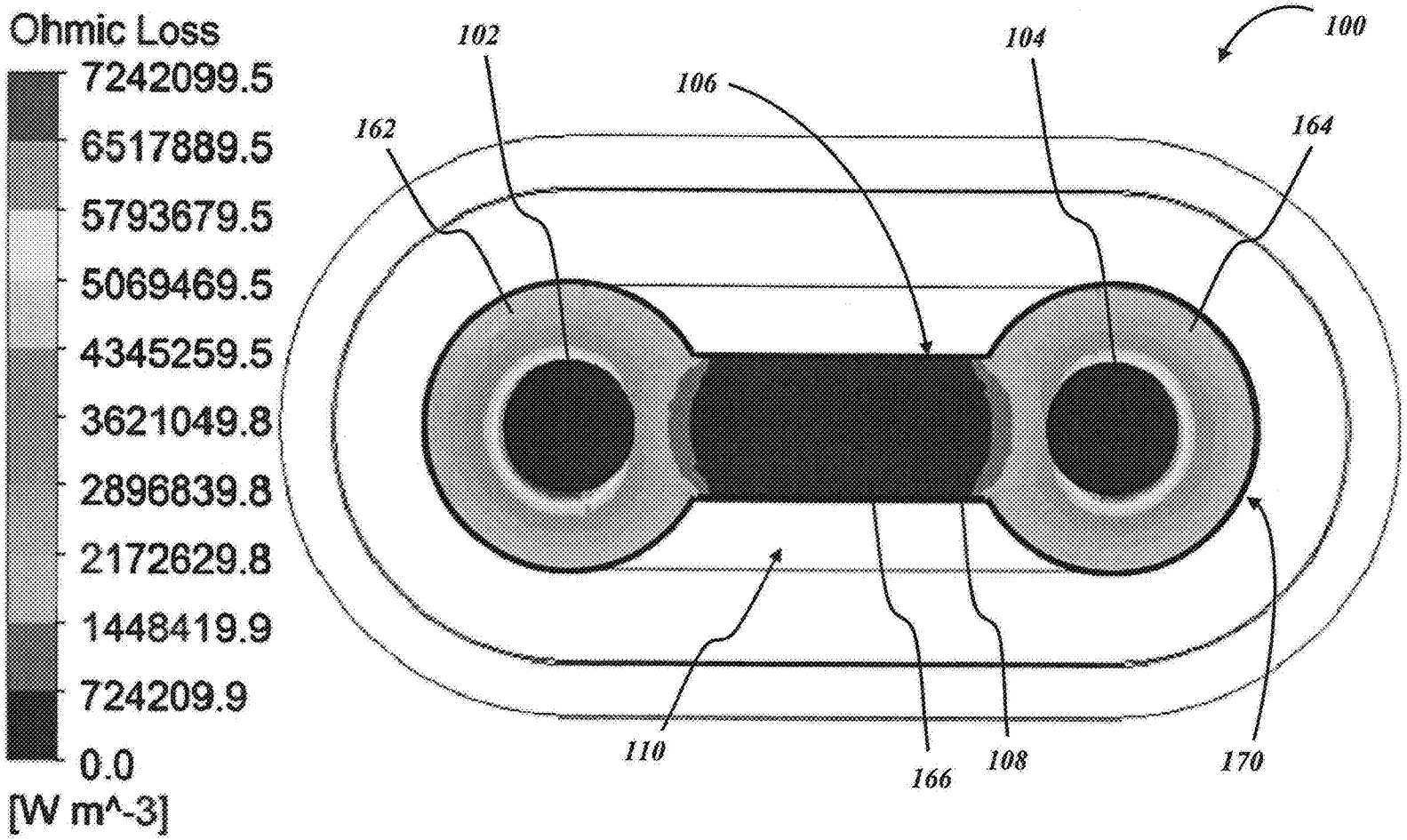
Figure 2C:
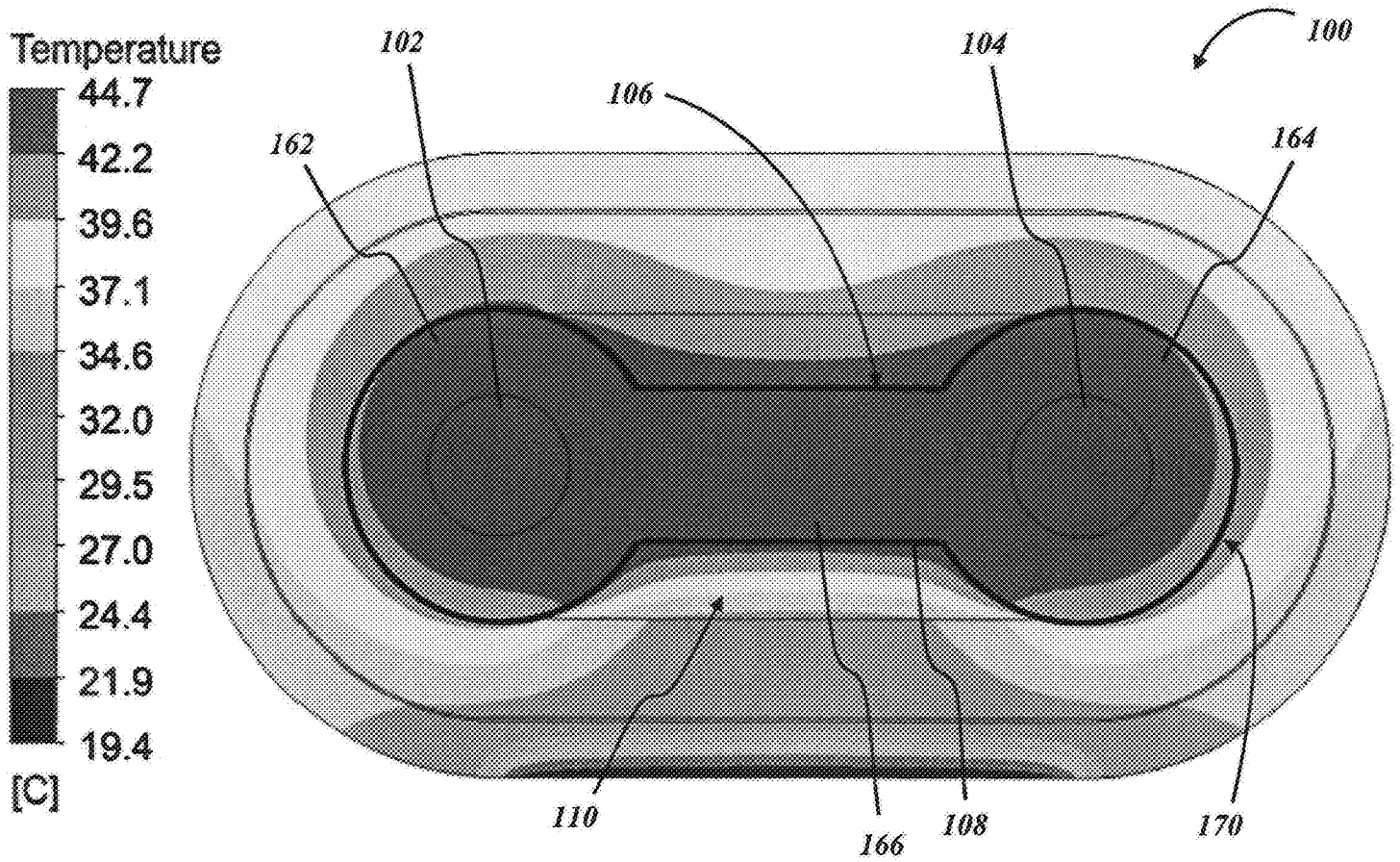
FIG. 2C is a cross-sectional diagram illustrating thermal characteristics of the heater cable of FIG. 1 in accordance with various embodiments of the present disclosure.

FIGS. 2A-C are discussed briefly above with respect to the construction of the exemplary heater cable 100 of FIG. 1. The data for these plots were collected from a heater cable 100 installed on a cold process pipe, as indicated by the temperature gradient at the "bottom" of the heater cable 100 in FIG. 2C. The plots detail the voltage and thermal output leveling of the heater cable 100. FIG. 2A shows that the voltage gradient dominantly occurs radially in the area where the heater core 106 PTC material encapsulates the bus wires 102, 104. Electrical current flows radially out of the first bus wire 102 onto the conductive layer 108, and finally the current flows radially into the second bus wire 104. The ohmic loss plot of FIG. 2B indicates that power generation dominantly occurs in the area where the heater core 106 material encapsulates the bus wires 102, 104. FIG. 2C shows that temperature across the heater core 106 PTC material is relatively uniform.

Figure 3:
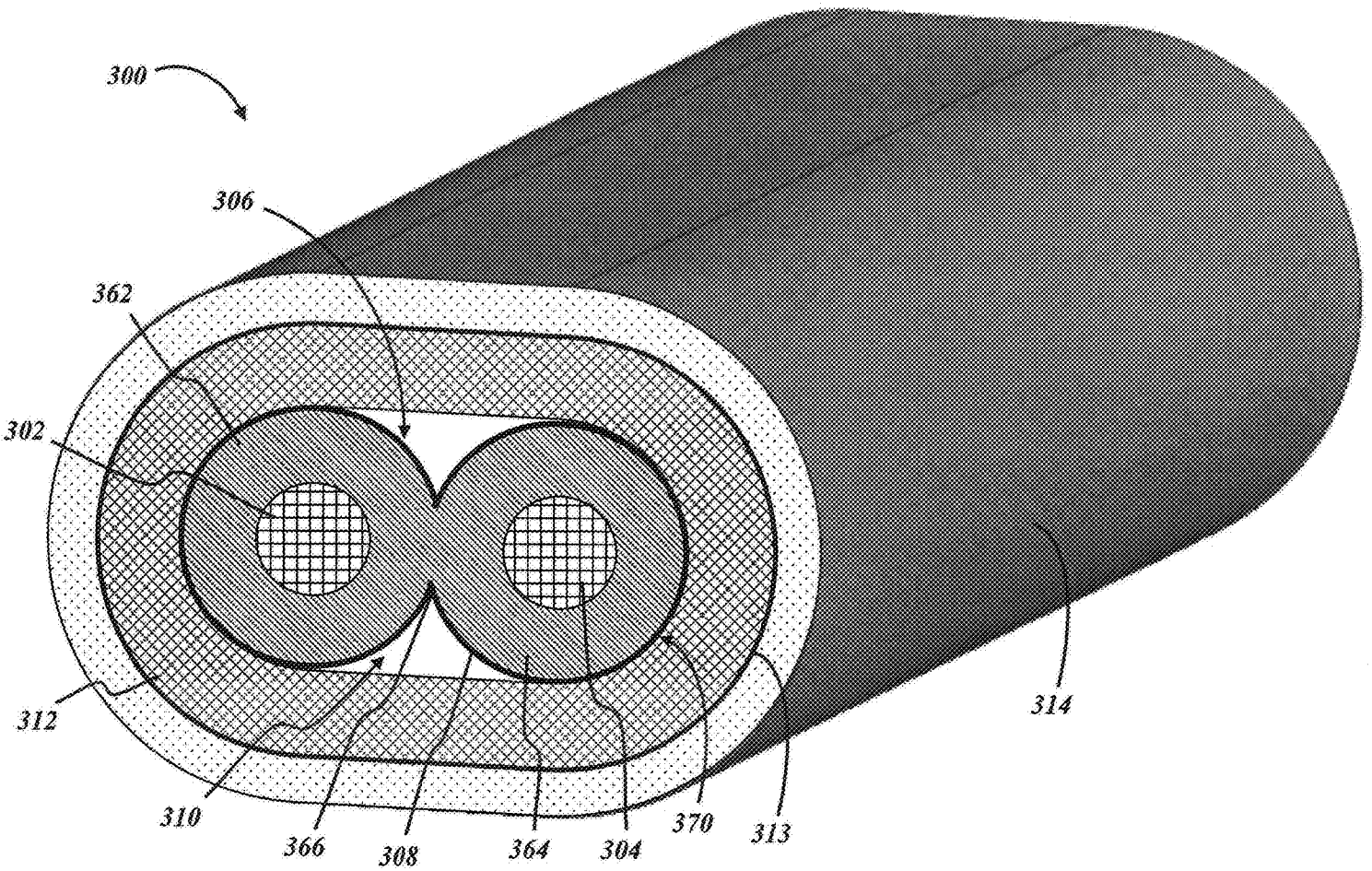
FIG. 3 is a cross-sectional diagram of another heater cable in accordance with various embodiments of the present disclosure.

FIG. 3 illustrates another exemplary embodiment of a heater cable 300 that is voltage-leveling as described above, but lacks a distinct web of PTC material spacing the bus wires 302, 304 from each other. In particular, a heater core 306 may have any of the properties described above with respect to the heater core 106 of FIG. 1, but a first lobe 362 encapsulating the first bus wire 302 may directly intersect a second lobe 364 encapsulating the second bus wire 304. The intersection 366 may be any suitable thickness, and may be at the midpoint of the distance between the bus wires 302, 304 to optimize voltage leveling. A conductive layer 308 having any of the properties described above with respect to the conductive layer 108 of FIG. 1; thus the conductive layer 308 may be disposed partly or entirely around the outer surface of the heater core 306, including around the curves 370 on each lobe 362, 364 and at the intersection 366 of the lobes 362, 364. An insulating layer 312 similar to the insulating layer 112 of FIG. 1 may be disposed over the conductive layer 108. A grounding layer 313 may be disposed over the insulating layer 312 as described above. And, an outer jacket 314 may be disposed over the ground layer 313 as described above.

Figure 4A:
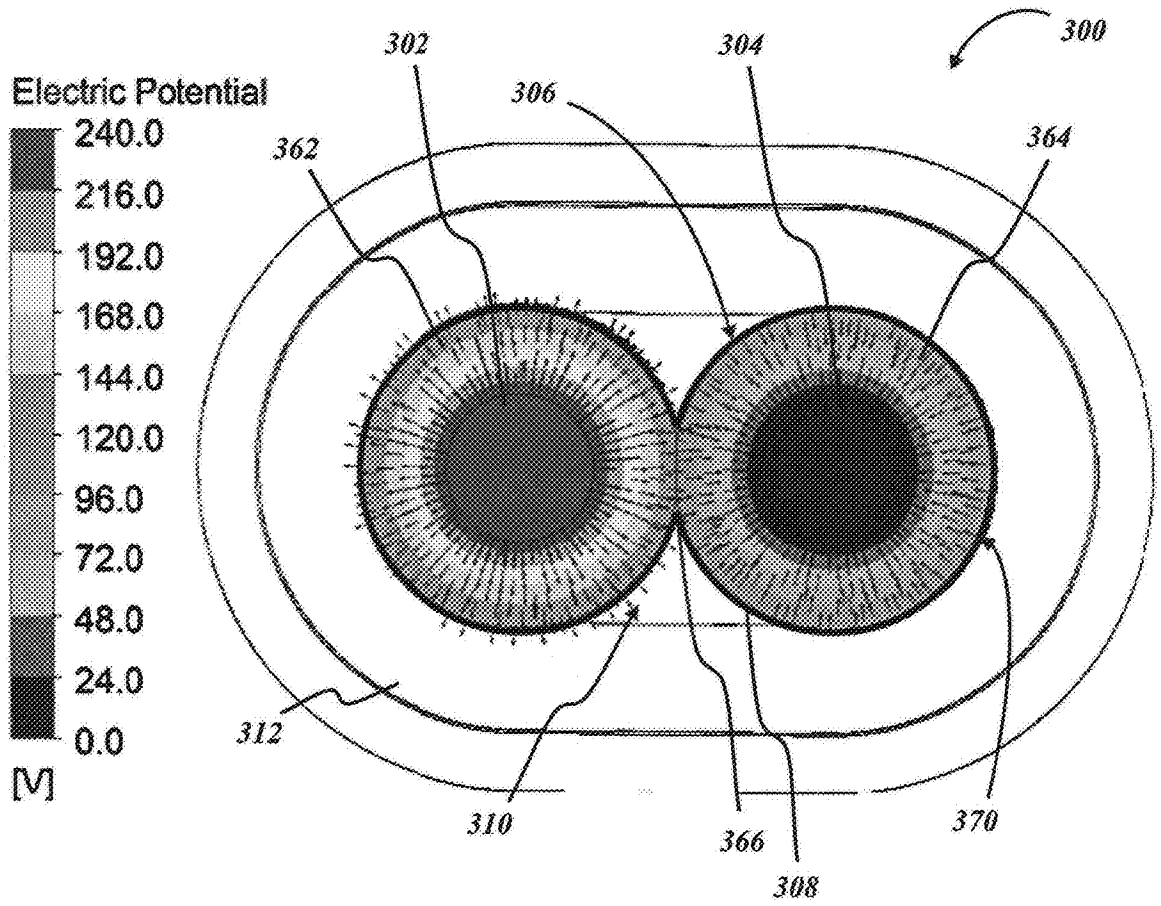
FIGS. 4A and 4B are cross-sectional diagrams illustrating electrical characteristics of the heater cable of FIG. 3 in accordance with various embodiments of the present disclosure.
Figure 4B:
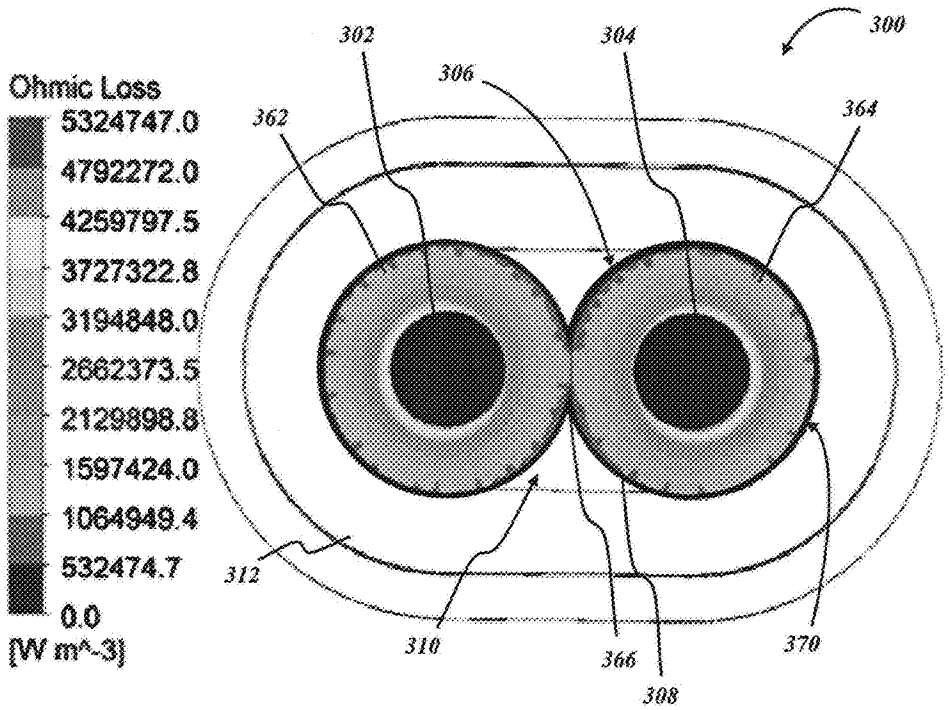
Figure 4C:
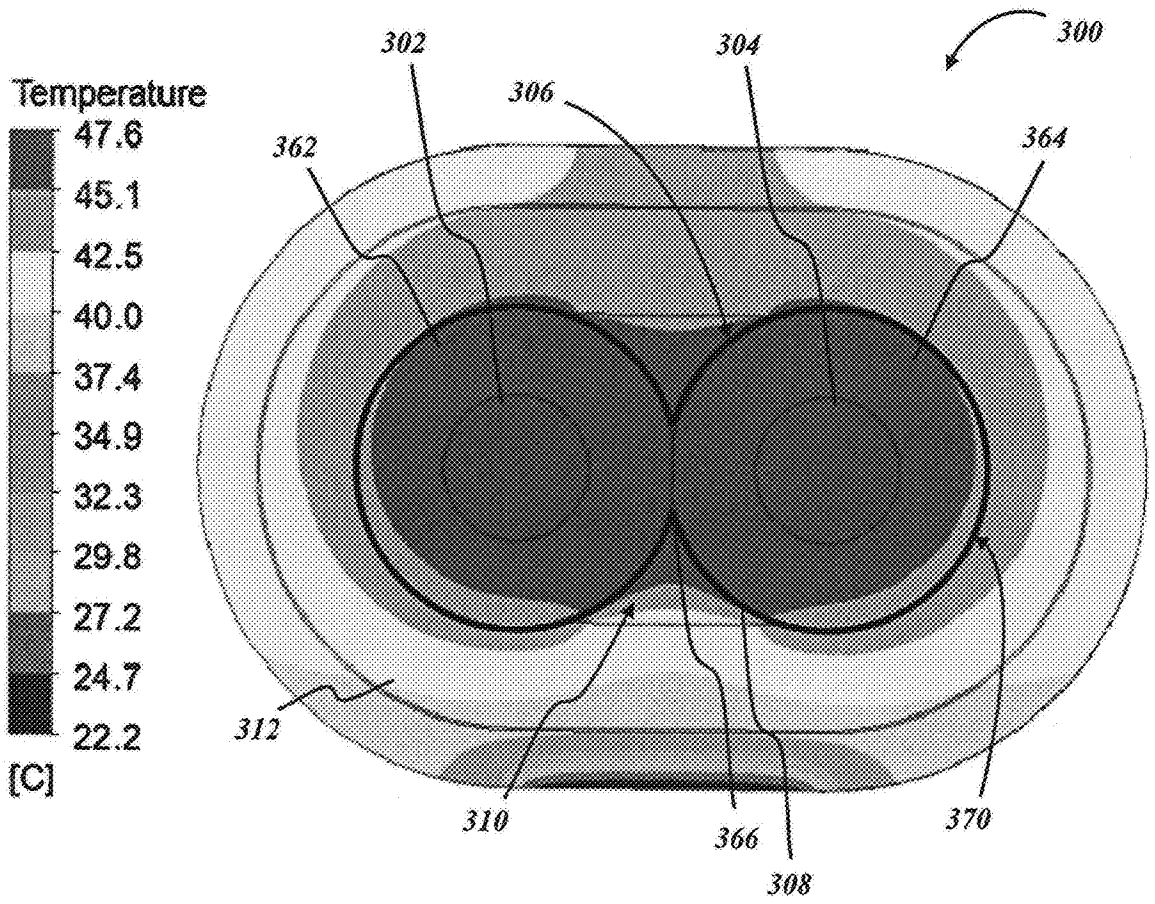
FIG. 4C is a cross-sectional diagram illustrating, thermal characteristics of the heater cable of FIG. 3 in accordance with various embodiments of the present disclosure.

FIGS. 4A-C illustrate operating conditions of the exemplary heater cable 300 disposed on a process pipe, as indicated by the temperature gradient at the "bottom" of the heater cable 300 in FIG. 4C. The plots detail the voltage and thermal output leveling of the heater cable 300. FIG. 4A shows that the voltage gradient dominantly occurs radially in the area where the heater core 306 PTC material encapsulates the bus wires 302, 304. Electrical current flows radially out of the first bus wire 302 onto the conductive layer 308, and finally the current flows radially into the second bus wire 304. The ohmic loss plot of FIG. 4B indicates that power generation dominantly occurs in the area where the heater core 306 material encapsulates the bus wires 302, 304. FIG. 4C shows that temperature across the heater core 306 PTC material is relatively uniform.

So configured, a heater cable is described capable of having improved thermal equalization characteristics according to various embodiments, such as those described above. Additionally, the design of the heater cable in various embodiments allows for customization of power output and cable width while maintaining a maximized thermal equalization, which, in particular, is a new and useful result. Further still, the heater cable in accordance with various embodiments is capable of being produced using existing monolithic SR heater cable components, such as existing heater core profiles.

The present invention has been described in terms of one or more preferred embodiments, and it should be appreciated that many equivalents, alternatives, variations, and modifications, aside from those expressly stated (e.g., methods of manufacturing, product by process, and so forth), are possible and within the scope of the invention.

What is claimed is:

1. An electric heater cable having a length and comprising:

a first bus wire and a second bus wire parallel to the first bus wire, the first and second bus wires each extending the length of the heater cable;

a heater core extending the length of the heater cable and comprising a positive temperature coefficient (PTC) semiconductive polymer, the heater core encapsulating and spacing apart the first and second bus wires and dissipating, to a surrounding environment as heat, a current applied to one or both of the first bus wire and the second bus wire; and a conductive layer disposed in surface contact with an outer surface of the heater core and leveling an electric potential across the outer surface of the heater core, the conductive layer extending entirely along the length of the heater cable and entirely covering the outer surface of the heater core.

2. The electric heater cable of claim 1, wherein the conductive layer has a uniform thickness.

3. The electric heater cable of claim 1, wherein the conductive layer is one of a conductive ink and a conductive paint both having a sufficiently high electrical conductivity to draw the current to the outer surface of the heater core.

4. The electric heater cable of claim 1, further comprising:

an insulating layer disposed over the conductive layer and over the heater core and providing a dielectric separation to the heater core;

a ground layer disposed over the insulating layer and providing an earth ground for the heater cable; and an outer jacket disposed over the group layer and forming an exterior surface of the heater cable, the exterior surface exposed to the surrounding environment.

5. The electric heater cable of claim 4, wherein a second conductive layer is disposed on an inner surface of the insulating layer.

6. The electric heater cable of claim 1, wherein the heater core has a barbell cross-sectional shape, the heater core forming a first lobe around the first bus wire, a second lobe around the second bus wire, and a web between the first and second bus wires, and wherein the conductive layer is disposed in surface contact with the outer surface of the heater core such that the conductive layer draws the current evenly through the first and second lobes.

7. A self-regulating heater cable comprising:

a pair of bus wires;

a monolithic heater core comprising at least one positive temperature coefficient (PTC) material, the heater core contacting and encapsulating the pair of bus wires, the at least one PTC material forming an outer surface of the heater core; and a conductive layer disposed on at least a first portion of the outer surface of the heater core such that a voltage measured at the first portion of the outer surface, the voltage caused by an electric current carried by the pair of bus wires, is leveled.

8. The heater cable of claim 7, wherein the heater cable has a length and the conductive layer extends entirely along the length of the heater cable.

9. The heater cable of claim 7, wherein the conductive layer entirely covers the outer surface of the heater core.

10. The heater cable of claim 7, wherein the conductive layer is further disposed on a second portion of the outer surface, the second portion spaced lengthwise from the first portion such that a third portion of the outer surface, the third portion disposed between the first portion and the second portion, is not in contact with the conductive layer.

11. The heater cable of claim 7, wherein the conductive layer is one of a conductive ink and a conductive paint applied to the outer surface of the heater core.

12. The heater cable of claim 7, wherein the conductive layer is a flexible conductive material and is wrapped around the heater core.

13. The heater cable of claim 7, wherein the conductive layer is an extruded layer.

14. The heater cable of claim 7, further comprising an electrically insulating layer disposed over the conductive layer and over the heater core and providing a dielectric separation to the heater core, wherein one or more air gaps are disposed between the insulating layer and the conductive layer.

15. The heater cable of claim 7, wherein the heater core has a cross-sectional shape including a first lobe formed around a first bus wire of the pair of bus wires and a second lobe formed around a second bus wire of the pair of bus wires, and wherein the conductive layer is disposed in surface contact with the outer surface of the heater core such that the conductive layer draws the current evenly through the first and second lobes.

16. A method of making an electric heater cable, the method comprising:

extruding one or more positive temperature coefficient (PTC) materials over a pair of bus wires to form a heater core that encapsulates the pair of bus wires and has an outer surface; and applying a conductive layer onto the outer surface of the heater core, the conductive layer positioned to draw an electric current carried by the pair of bus wires evenly through heater core such that a voltage measured at the outer surface in contact with the conductive layer is leveled.

17. The method of claim 16, wherein applying the conductive layer comprises coating the outer surface with one or both of a conductive ink and a conductive paint.

18. The method of claim 16, wherein applying the conductive layer comprises co-extruding a conductive material together with the one or more PTC materials.

19. The method of claim 16, wherein applying the conductive layer comprises extruding a conductive material onto the heater core.

20. The method of claim 16, further comprising combining one or more polymer compounds with one or more conductive fillers to produce a first PTC material of the one or more PTC materials.

* * * * *